United States Patent [19]

Adamson

[11] 4,428,097

[45] Jan. 31, 1984

[54] PROCESS AND APPARATUS FOR STOPPING DRAW FRAMES AND THE LIKE

[75] Inventor: Fletcher D. Adamson, Alexander City, Ala.

[73] Assignee: Russell Corporation, Alexander City, Ala.

[21] Appl. No.: 470,771

[22] Filed: Feb. 28, 1983

[51] Int. Cl.[3] ..... D01C 31/00

[52] U.S. Cl. ..... 19/0.25

[58] Field of Search ..... 19/0.21–0.27

[56] References Cited

U.S. PATENT DOCUMENTS

| | | | |
|---|---|---|---|
| Re. 24,212 | 9/1956 | Harris | 19/0.25 X |
| 3,010,273 | 11/1961 | Bailey | 19/0.25 X |
| 3,262,160 | 7/1966 | Cardon | 19/0.25 |
| 3,271,823 | 9/1966 | Whitehurst | 19/0.25 |
| 3,310,844 | 3/1967 | Robertson | 19/0.25 |
| 3,363,285 | 1/1968 | Foster | 19/0.25 |
| 4,065,831 | 1/1978 | Huntsinger | 19/0.25 |
| 4,095,062 | 6/1978 | Savageau | 19/0.25 X |

FOREIGN PATENT DOCUMENTS

| | | | |
|---|---|---|---|
| 1172167 | 6/1964 | Fed. Rep. of Germany | 19/0.21 |

*Primary Examiner*—Louis Rimrodt

*Attorney, Agent, or Firm*—Woodford R. Thompson, Jr.

[57] ABSTRACT

Disclosed is a process and apparatus for stopping the drawing action of a draw frame whenever sliver breaks. The sliver is pneumatically conveyed into the field of influence of a sensor which generates a signal indicating the presence of the broken sliver therein. This signal is used to stop the draw frame, thus eliminating the production of sub-weight sliver or roving.

5 Claims, 7 Drawing Figures

FIG. 1
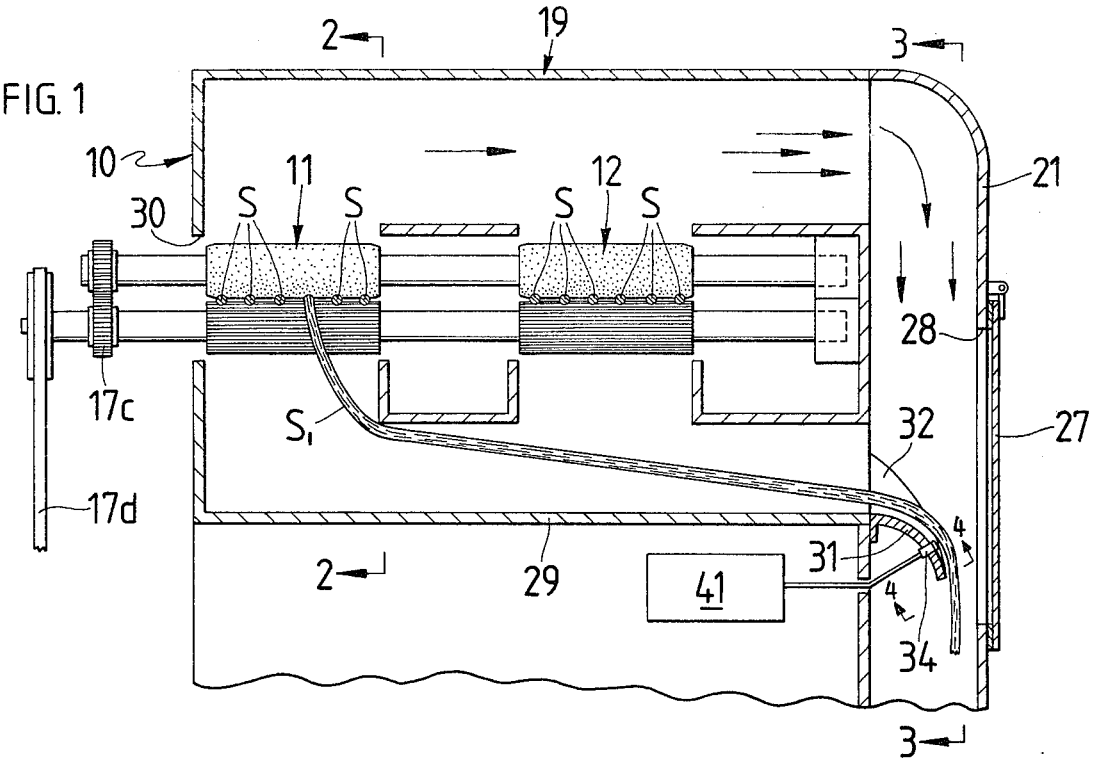
FIG. 2
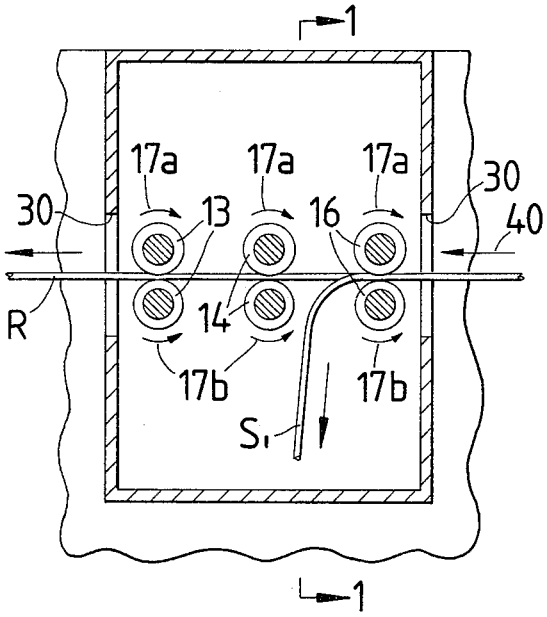
FIG. 3
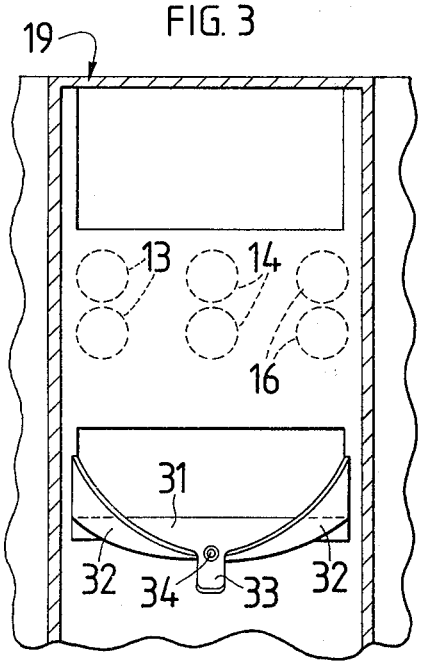
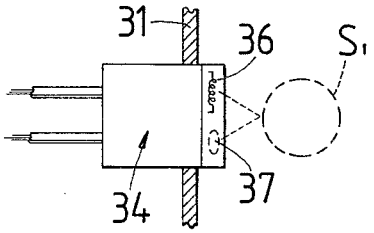
FIG. 4
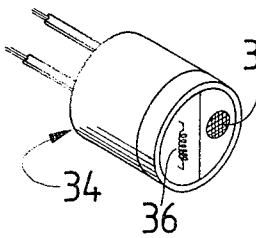
FIG. 5

PROCESS AND APPARATUS FOR STOPPING DRAW FRAMES AND THE LIKE

BACKGROUND OF THE INVENTION

This invention relates to a process and apparatus for stopping the attenuating action of a draw frame whenever an end or sliver passing therethrough breaks or otherwise fails properly to pass between the drafting rolls of the machine.

As is known, draw frames are employed to attenuate, parallelize and blend a plurality of slivers or ends, thus producing a combined sliver or roving representative of the characteristics of the various slivers which have been combined. In these machines a plurality of fibers made from varying grades of cotton or other materials is fed simultaneously, in parallel fashion, through the drawing rolls of the machine. The emerging, combined, single sliver or roving thus represents a true mixture of all of the fibers fed into the apparatus.

The machines in question also customarily have been equipped with suction hoods over the entire drafting sections thereof. These hoods or compartments are connected to a suction system leading to a collector for dust, fly, trash and the like which may be discharged during the drafting operation. In view of this arrangement whenever one of the slivers or ends being fed into the draw frame breaks, that end is drawn by the suction away from the normal flow of the material being drafted and proceeds to the collector via the suction fan. It has been found that ends or slivers may break in these machines and go unnoticed for a considerable length of time. This results in the production of lightweight, unsuitable sliver, the short weight of which eventually is reflected in the finished yarn. Also, if permitted to go on for a long enough time, these down ends cause chokes in the suction system. So far as I am aware, there heretofore has been no suitable way to warn the operator that an end is down inside the hood and that the machine should be stopped.

My invention relates to means automatically to shut down the drafting frame whenever an end or sliver mis-feeds or breaks.

Briefly, my invention comprises a sensor having a field of influence located at a point in the suction system by which a broken sliver passes on its way out of the apparatus, into the collector. The field of influence through which the broken end passes generates a signal upon the presence of the end passing through said field of influence. Further, in view of the fact that during normal operation of draw frames of the kind described, there is a discharge of fly, dust, trash and the like, I so design the sensor that it is responsive only to the presence of sliver as distinguished from the aforementioned particles being discharged.

In view of the foregoing it will be seen that an object of my invention is to provide an economical, efficient process and apparatus for automatically stopping draw frames and the like upon the mis-drawing or breaking of an end or sliver passing therethrough.

A more detailed object is to provide a guide for the sliver located in the suction duct which is effective to cause the broken end to pass into the field of influence of a sensor, thus assuring that the sensor produces a signal indicative of the presence of a broken end.

Another object is to provide a process of the character designated in which a broken end is moved away from the normal path of movement of the ends passing through the drawing apparatus, preferably generally normal to said path, passed through a field of influence, thus to generate a signal, and using that signal to shut down the drawing frame and to shut down the suction fan, if each individual draw frame is equipped with a suction fan as distinguished from being tied into a system where one fan serves more than one draw frame.

DESCRIPTION OF THE DRAWINGS

Apparatus illustrating the constructional features of my invention and which may also be used to carry out my improved process is shown in the accompanying drawings forming a part of this application, in which:

FIG. 1 is a somewhat diagrammatic, detail fragmental view of a more or less conventional draw frame taken generally along line 1—1 of FIG. 2 and showing my invention in association therewith;

FIG. 2 is a detail, fragmental view taken generally along line 2—2 of FIG. 1;

FIG. 3 is a detail, fragmental view taken generally along line 3—3 of FIG. 1;

FIG. 4 is a fragmental detail view taken along line 4—4 of FIG. 1;

FIG. 5 is an isometric view of one form of sensor which may be employed as a part of my invention;

DETAILED DESCRIPTION

Figure 7:
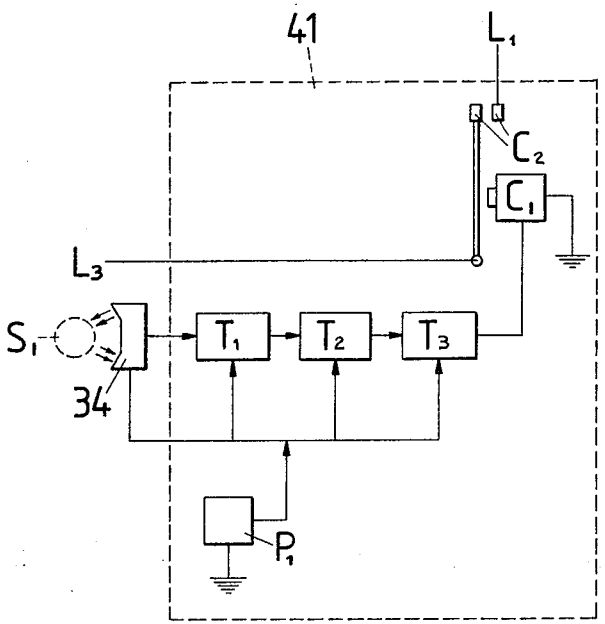
FIG. 7 is a wholly diagrammatic wiring diagram illustrating the delay circuitry for the sensor.

Referring now to the drawings for a better understanding of my invention, I will describe the same in association with a standard, commercially available form of draw frame. While I have selected a specific form of draw frame for the purpose of illustration, after my invention is fully understood it will be apparent that the same may be adaptable to various other drafting operations and machines.

In the drawings the draw frame is indicated generally by the numeral 10. As is understood, the draw frame comprises two groups of feed rolls 11 and 12. As seen in FIG. 2 each group of rolls 11 and 12 comprises drafting roll pairs indicated by the numerals 13, 14 and 16 in FIG. 2.

The rolls are mounted on the respective shafts as shown and are driven in the direction of the arrows **17*a* and 17*b*, FIG. 2. This is usually accomplished by the provision of gears 17*c* on each pair of the rolls 13, 14 and 16. One of the shafts, for instance, the lower shaft of each set, may be driven by gearing, not shown, from a single source of power. In the drawings I have illustrated this driving of the entire groups of rolls as being by means of a belt 17*d* driven by a draw frame motor 17*e***.

As is understood, also, the type of draw frame being described is provided with a fly, dust and trash collection hood indicated generally by the numeral 19. This hood surrounds the portion of the apparatus where the drafting is taking place. Connected to the upper portion of the hood is a duct 21. Duct 21 preferably leads downwardly and is connected at its lower end to the intake of a suction fan 22. The suction fan discharges into a collector 23. See FIG. 6. The suction fan is driven through a belt 24 by a motor 26. If desired, the outer wall of the duct 21 may be provided with a glass or other transparent cover 27 for an opening 28 through said wall. Air is admitted into the housing through the openings 30. The velocity of the air flow through the hood is greater than the linear rate of speed of the sliver while being drafted.

The foregoing is a description, generally, of a type of frame to which my invention is applicable.

As stated, my invention comprises apparatus and process of operating the frame so that it is shut down when an end breaks or otherwise enters the duct 21.

Adjacent a lower wall 29 forming part of the enclosure and projecting into the suction duct 21 I mount a plate-like guide member 31. This member is somewhat semi-funnel shaped and has sides 32 which slope upwardly as indicated in FIG. 3 from a low point indicated at 33.

At the low point 33 of the guide member 31 I place a sensor indicated by the numeral 34. While various types of sensors may be adequate for the purposes at hand, I prefer to use a photocell-type device which carries its own energy emitting source 36 and an energy-responsive element 37. In practice, I have found that a photocell sensor manufactured by Optron, Inc., 1201 Tappan Circle, Carrollton, Tex. 75006, identified as its part No. OPB730F is entirely suitable. Suffice it to say that the object of the sensor is to establish a field of influence adjacent the "neck" of the funnel-shaped member 31 so that, upon the presence of a broken or mis-drafted end or sliver $S^1$ in said area a signal is generated by the sensor. See FIG. 1.

Figure 6:
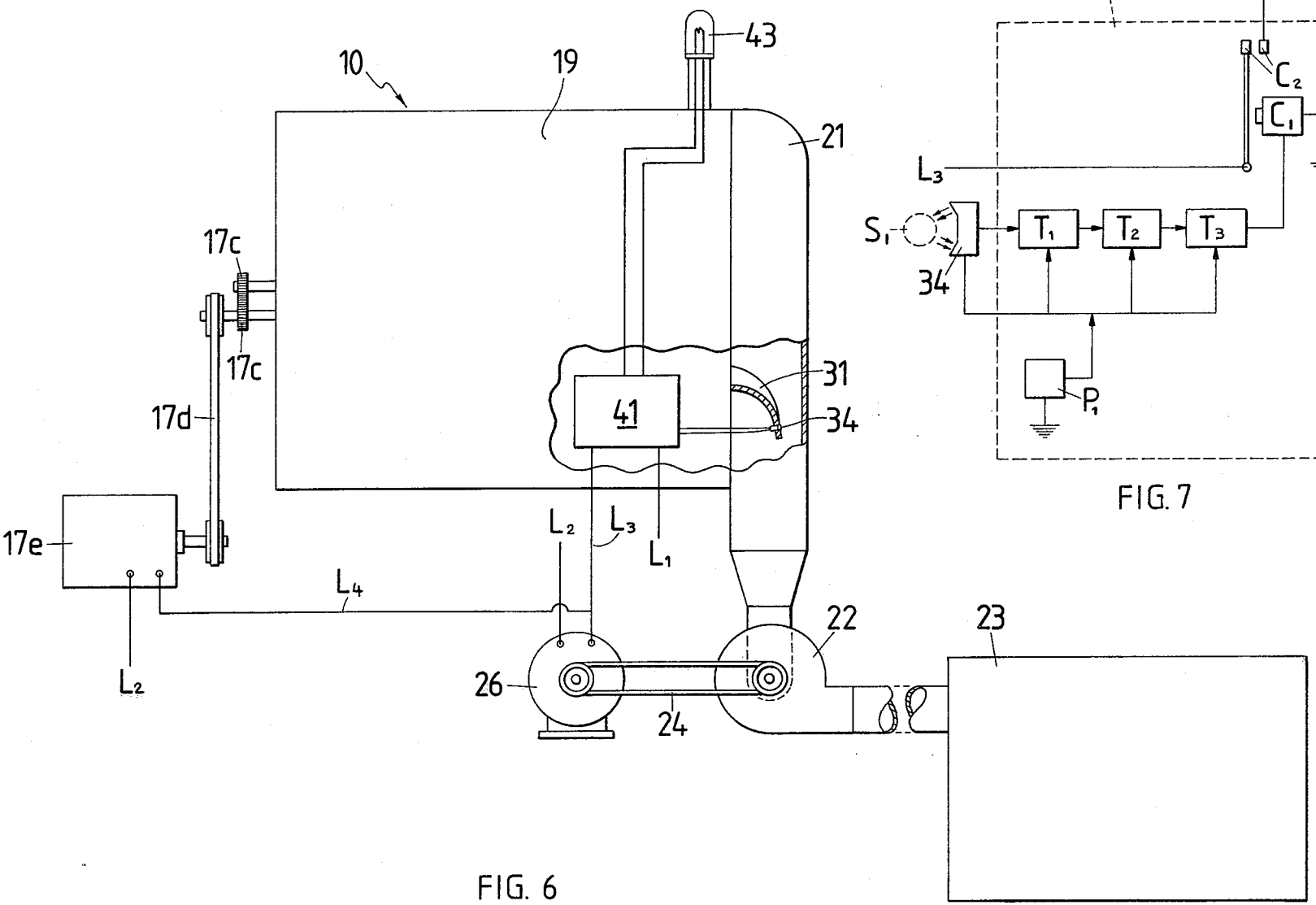
FIG. 6 is a wholly diagrammatic wiring diagram.

In order to prevent the giving of false signals due to the passage through said zone of influence of fly, trash or dirt, the sensor 34 is in circuit with time delay means. Referring particularly to FIG. 7 of the drawings, I show the sensor 34 diagrammatically in circuit with devices capable of providing the delay. Thus, within the control box 41, or elsewhere if desired, I feed the signal from the sensor 34 to a shaper-timer indiated at $T^1$. The signal is then sent to a reset timer $T^2$ and thence to a one-shot timer $T^3$. Each of these timers may be purchased from Motorola, Inc., Post Office Box 20912, Phoenix, Ariz. 85036. The output of the one-shot timer is fed to the coil $C^1$ of a relay. The relay controls contact points $C^2$ which are in circuit with the motors 17*e* and 26 through the lines $L^3$ and $L^4$ as shown in FIGS. 6 and 7. A low voltage power supply, such as a 15 volt system indicated at $P_1$ powers the system as indicated in FIG. 7. A relay $C^1$ suitable for the purposes at hand may be purchased from American Zettler, 16881-3 Hale Ave., Irvine, Calif. 92705 under its part No. A2-1530-08-1.

From the foregoing it is now possible to explain the operation of my improved process and apparatus and more fully to understand the advantages thereof. As stated, a plurality of slivers or ends indicated by the numeral S is fed into the machine for drafting, for instance, from the side indicated by the arrow 40, FIG. 2. Normally, all of the ends pass through the drafting rolls and come out as a combined sliver or roving indicated by the letter R, FIG. 2. On occasions, one of the ends of slivers indicated at $S^1$ breaks or otherwise is drawn away from the normal path of movement of the slivers being drafted and hence, due to the flow of air through the housing, moves downwardly and into the suction duct 21. Due to the shape of the member 31 this sliver passes into the field of influence maintained by the sensor 34, hence giving a signal indicative of its presence therein. It will be seen that since the free end of the broken sliver is acted upon by the flowing stream of air in the system, the sliver moves substantially axially driving its travel through the field of influence. As indicated diagrammatically in FIG. 6, this signal is fed to a combined amplifier and motor control unit located diagrammatically at 41. Also as diagrammatically shown in FIG. 6 these signals are used to deenergize the motors 17*e* and 26 whenever a sliver is in the said field of influence.

From the foregoing it will be seen that I have devised an improved process and apparatus fully effective automatically to stop a draw frame whenever an end goes down. In actual practice my invention has proven to be extremely satisfactory. The prime object of eliminating the production of under-weight sliver is achieved thus reducing the overall cost and reducing the amount of sub-weight yarn spun from such sliver.

It might be mentioned that if desired a signal light 43, operated by suitable contacts in the control mechanism 41 may be provided atop the machine to indicate to the operator when the same is shut down.

While I have shown my invention in but one form, it will be obvious to those skilled in the art that it is not so limited, but is susceptible of various changes and modifications without departing from the spirit thereof.

What I claim is:

1. In apparatus for stopping a roll-type draw frame of the kind in which a sliver when broken moves away from the path of slivers drafted by the rolls of the machine, (a) means to move broken slivers from all the rolls along a common, converging path, whereby all broken slivers from all the rolls pass by substantially the same location in the apparatus, (b) a sensor having a field of influence located immediately adjacent the common converging path of said broken slivers and effective to generate a signal in response to the presence of said broken slivers in said field, and (c) means to utilize such signal to stop the drafting action of the frame.

2. Apparatus as defined in claim 1 in which said sensor is unresponsive for the purpose of stopping the frame to the presence in its field of influence of fly, dust, trash and the like passing therethrough.

3. Apparatus as defined in claim 2 in which the sensor is provided with means to delay the signal producing function thereof when sliver initially enters said zone of influence, said means affording a time delay of such duration to cause production of said signal only by the passage into said field of influence of sliver as distinguished from fly, dust, trash and the like.

4. The process of stopping a draw frame responsive to the mis-drawing of an end passing therethrough comprising:

(a) directing all of the mis-drawn or broken ends along a common, converging path removed from the path taken by the ends during normal drafting, (b) generating a signal indicative of the fact that a broken end is proceeding along said common, converging path, and (c) employing said signal to stop the drafting action of the frame.

5. The process of claim 4 in which said signal is generated while said sliver is moving substantially axially along said common, converging path.

* * * * *